United States Patent [19]

Rosenlind et al.

[11] 4,352,441

[45] Oct. 5, 1982

[54] TUBE KEY

[75] Inventors: K. Göran Rosenlind; S. B. Thomas Brandberg, both of Lindingö, Sweden

[73] Assignee: Svenska Streck Aktiebolag, Stockholm, Sweden

[21] Appl. No.: 128,353

[22] PCT Filed: Mar. 30, 1979

[86] PCT No.: PCT/SE79/00077

§ 371 Date: Dec. 6, 1979

§ 102(e) Date: Nov. 27, 1979

[87] PCT Pub. No.: WO79/00887

PCT Pub. Date: Nov. 1, 1979

[51] Int. Cl.[3] ..... B65D 35/32

[52] U.S. Cl. ..... 222/99

[58] Field of Search ..... 222/99, 100, 96, 97, 222/98, 104

[56] References Cited

U.S. PATENT DOCUMENTS

| | | | |
|---|---|---|---|
| 1,669,247 | 5/1928 | Johnson | 222/99 X |
| 1,894,152 | 1/1933 | Bolz | 222/99 |
| 2,035,713 | 3/1936 | McMackin | 222/99 |

FOREIGN PATENT DOCUMENTS

| | | | |
|---|---|---|---|
| 125349 | 4/1928 | Switzerland | 229/99 |
| 664032 | 1/1952 | United Kingdom | 222/99 |

*Primary Examiner*—Stanley H. Tollberg
*Attorney, Agent, or Firm*—Larson & Taylor

[57] ABSTRACT

The invention relates to a tube key for exuding a product (7) which is packed in a tube (5), comprising a handle (1) which carries two parallel legs (2) which are free at the ends (4) and which are provided on a distance from each other which is 0.25–0.75 of the average diameter of the legs. At least the two legs (2) are made of a springy material, and the diameter or the average cross section width of the legs (2) is at least twelve times the thickness of the material of the tube (5) for which the tube key is intended to be used. The legs (2) of the tube key preferably are at least twice as long as the average diameter of the tube (5) for which the key is to be used and one of the legs can be formed with structure for increasing the hold between the tube and the leg, for instance rifles (10) or a longitudinal slot (11) open at the end opposite the handle.

3 Claims, 6 Drawing Figures

TUBE KEY

The present invention relates to a tube key for exuding by a rotating movement products which are packed in collapsable exuding tubes.

The exuding tube is a hygienic, practical and economical package which is used for many different products. However, depending on several facts such as the stiffness of the product, the present relatively stiff tube materials which are difficult to roll etc. the tubes are used to a relatively restricted extent. Tubes made of metal such as aluminium or any light metal alloy are so stiff, that problems arise for many people when exuding the product by rolling the tube up from the end thereof. Either the said persons do not manage to exude the product from the end and therefore the tube is squeezed somewhere closer to the opening or the tube is folded or shrivelled during the attempts to roll up the tube. In both cases a substantial amount of the contents of the tube gets lost and the tube obtains a non-essential appearance. When exuding by hand of products contained in tubes of plastic material, which are generally somewhat elastic the additional problem is met with in that it is difficult to exude the content of the tube from the end. Also the additional problem is met with that the tube regains its initial form as soon as the tube is let free so that the air is sucked into the tube. Such air which is introduced into the tube may contaminate the content of the tube or provide a precipitation of liquid or any other substance of the packed product.

Previously tube keys were often used consisting of a piece of metal plate having a punched groove or a key of a metal wire in the form of a sling likewise providing a groove in which the end of the tube can be introduced. Such keys, however, normally are far too weak to withstand the stiff tubes nowadays appearing on the market or tubes containing stiff products. Further the said keys are supplied separately but as non-reusable keys which many times provide problems in handling a supply and which often get lost. Even if the keys actually might be reused this involves some trouble in that the tube, after the content is exuded must be unrolled, so that the end of the tube can be released from the groove of the key. The said previously known keys generally are formed so that the groove, with a fairly good fit, is adapted to the end of the tube, and the keys have such a small outer diameter that the tube, at least during the first turns, must be rolled onto the key with a very little radius of curvature. For this reason the material is easily folded or shrivelled and the tube may move sideways when being rolled up so that finally a longitudinal end of the tube is left un-exuded.

A basis of the invention is to provide a tube exuding key which is intended to be re-used and by means of which different types of tubes can easily be exuded, which can easily be released without unrolling when the tube is emptied, and which by its special form actually contributes to the exuding of the product packed in the tube.

According to the invention the tube key is formed with a handle which carries two parallel legs of a springy material which are free at the ends opposite the handle, so that the legs can resiliently be bent inwards and outwards respectively, and in which the free distance between the legs is at least twelve times as large as the thickness of the material from which the tube is made.

According to a special embodiment of the invention the free distance between the freely supported parallel legs is 0.25 to 0.75 of the average diameter of the legs, and the diameter of the legs should be at least 16–48 times as large as the thickness of the tube material, the "tube material" of course being one of the two plies of a flattened tube.

Further characteristics of the invention will be evident from the following detailed specification in which reference will be made to the accompanying drawings.

In the drawings

Figure 1:
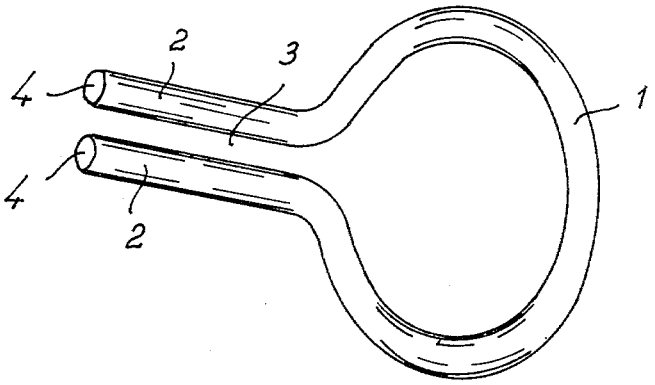
FIG. 1 is a perspective view of an embodiment of a tube key according to the invention.

The tube key illustrated in FIG. 1 is made of a round material, for instance a round bar of stainless steel or spring steel which is bent to a substantially circular handle 1 which at the ends merges in two parallel legs 2. The length of the legs should be about twice the average diameter of the tube for which the key is intended to be used. The least free distance 3 between the legs should be at least twelve times the thickness of the material that the tube is made of, whereby the flattened tube end comprising two layers of tube material with large play can be introduced in the gap 3 between the legs 2. The legs 2 which are free at the ends 4 thereof opposite the handle 1 should be made of such coarse material that the least free distance in the gap 3 between the legs 2 is 0.25 to 0.75 of the average diameter of the legs, and the legs 2 have a diameter which is between sixteen and forty eight times the thickness of the tube material. Compared with conventional tube keys the key according the invention therefore has a very large circumference and a very wide gap 3 between the legs 2 at the same time as the legs 2 are springy and are free at one end thereof. This is essential to the invention in order to make it possible to pull out the tube key laterally after the tube is squeezed empty and to provide a spring action against the tube that contributes to keep the tube end well clamped between the two legs 2 and the outer turns of the tube lying thereover. By the spring action the tube key provides a kind of pumping activity assisting the exuding of the content of the tube at the open end thereof.

Figure 2:
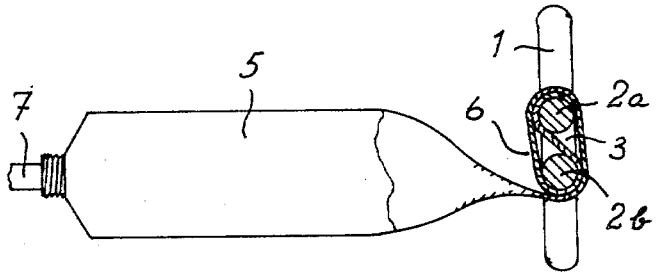
FIG. 2 shows the tube key of FIG. 1 used in connection with an exuding tube.

In FIG. 2 is illustrated diagrammatically a cross section of the key according to FIG. 1 applied on a tube 5, and in which a couple of turns 6 of the tube have been rolled on the key. When applying the key to the tube end, the flattened end is introduced in the gap 3 and is folded about one of the legs **2*a* and is held secured by the thumb when the key is being rotated by means of the handle 1. Thereby the tube end is laid in S-form first around one leg 2*a* and thereafter round the second leg 2*b*, whereafter the tube end is clamped between the first leg 2*a* and the subsequent turn 6 of the tube. Since the legs 2 are springy they are resiliently clamped somewhat together when the tube is squeezed in connection with the exuding of the content 7 thereof, and as the rotating movement is stopped the legs 2 tend to move apart by the spring action, whereby the tube content which may be present in the part of the tube lying just ahead of the second leg 2*b* is pressed forwards in the tube by a pump like activity. When the entire tube is squeezed empty and it is consequently wound around the legs 2 the key is easily released by simple being drawn out laterally, which does not meet any problems since the gap 3 between the legs 2 is substantially larger than the two layer tube material and since the legs 2** are springy and have open free ends.

Figure 3:
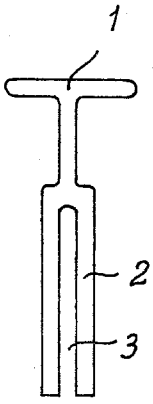
FIGS. 3–6 show four different embodiments of a tube key according to invention.
Figure 4:
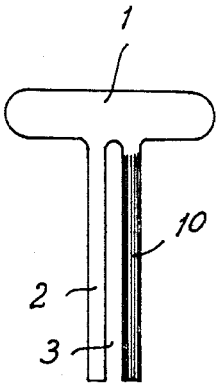
Figure 5:
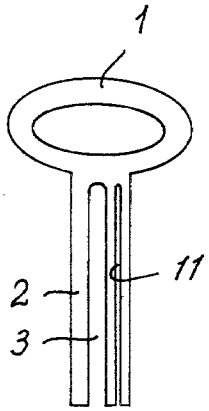
Figure 6:
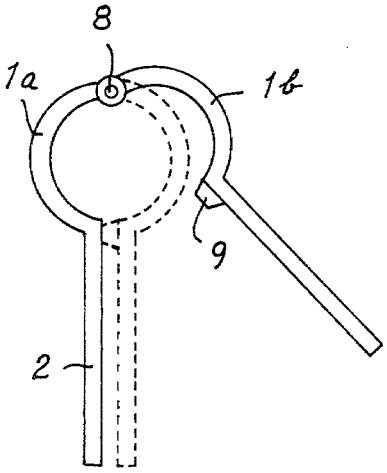

In FIGS. 3, 4 and 5 are illustrated three different embodiments of tube keys according to the invention which all comprise a handle 1 and two parallel legs 2 which are springy and free at the ends opposite the handle 1. In FIG. 6 is shown an alternative embodiment of the tube key according to the invention in which the key is formed as two halves, each including a handle half 1*a*, 1*b*. The two handle halves are connected by an intermediate joint 8 so that the handle halves can be rotated out from each other. In order to get a correct parallel distance between the two legs 2 one half is formed with a shoulder 9 which keeps the two legs 2 at a correct mutual distance from each other when the legs are moved together.

In many cases it may be preferable to form the legs with other cross sectional forms than the circular form, for instance with a square form, rectangular form or any other polygonal cross section form. In order to give a good hold between the legs and the tube the legs can be formed with riffles 10 as indicated in FIG. 4 or one leg can be formed with a narrow slot 11 as indicated in FIG. 5 in which the compressed tube end can be introduced laterally. In this case, however, the leg 2 having the slot 11 ought to have somewhat larger diameter than the other leg so that the two legs have substantially the same spring action.

The embodiment illustrated in FIG. 6 can be formed as a screw lid opener with the handle portion 1*a*, 1*b*, and the key besides can be combined with any other domestic apparatus like a tin-opener or similar means.

In a practical embodiment of a tube key according to the invention intended for exuding the contents of for instance caviar tubes having an average diameter of thirty mm the tube key was made as illustrated in FIG. 1 of stainless steel having a circular cross section form and six mm diameter. The free gap 3 between the legs 2 was three millimeters, the length of the legs between the outer ends 4 and the point were the legs merge into the handle 1 was sixty mm and the outer diameter of the handle 1 was sixtyfive mm. By means of the said tube key the caviar tube could very easily be emptied by rolling the tube onto the legs what was made without any inclined drawing of the tube, the tube did not fold or shrivel and the tube was emptied to a substantially larger extent than was possible by an optimum strong rolling up of the tube end by hand.

Of course the legs 2 can be given any wanted length but the least length preferably should be twice the average diameter of the tube for which the key is intended.

The above described tube key may as well be used for tubes of metal such as light metal or any aluminium alloy or for tubes made of plastic or any other material. Especially when used on tubes of such resilient materials like plastic the use of the tube key according to the invention is advantageous in that the content 7 of the tube is always pressed out from behind and in that the content both at the tube end and along the edges provides a sealing which prevents air from being sucked into the tube as may happen when pressing the content out by hand. Also the spring action provided by the springy legs acts for this purpose even after the tube key is let free. As long as the tube key is kept on the tube it prevents the tube from unrolling, depending on the large mass and the large size of the tube key, even if the tube material is very elastic and tends to regain its initial form.

It may, however, be pointed out that the tube key upon need can be released even from a half emptied tube and it can easily be remounted in that the legs are pressed somewhat together to enter the former hose between the S-sling and the outer tube turns.

Since the tube key can be formed very coarse it can be used even for every stiff products like stiff paints, filler, butter or margarine, treacle and many other stiff products and products which are difficult to handle.

It is to be understood that the above specification and the embodiments of the invention illustrated in the drawings are only illuminating examples and all kinds of different modifications may be presented within the scope of the appended claims.

We claim:

1. Tube key for exuding a product packed in a soft tube by compressing the tube to flatten it and rolling same onto the tube key, said tube key comprising a handle carrying two parallel legs of substantially circular cross section which are free at the ends thereof opposite the handle, the legs of the tube key being made of a springy material such as a springy metal, a springy glass fibre material or plastic material, said legs being constructed and arranged to spring outwardly against the material of the tube as the tube is rolled onto the key, the least free distance between the legs being 0.25–0.75 times the average diameter of the legs and the average diameter of legs being 16–48 times the thickness of the material of the tube, and wherein one of the legs is formed with a slot which is open outwards opposite the handle and the width of which slot is slightly larger than twice the thickness of the tube material.

2. Tube key for exuding a product packed in a soft tube by compressing the tube to flatten it and rolling same onto the tube key, said tube key comprising a handle carrying two parallel legs of substantially circular cross section which are free at the ends thereof opposite the handle, the legs of the tube key being made of a springy material such as a springy metal, a springy glass fibre material or plastic material, said legs being constructed and arranged to spring outwardly against the material of the tube as the tube is rolled onto the key, the least free distance between the legs being 0.25–0.75 times the average diameter of the legs and the average diameter of legs being 16–48 times the thickness of the material of the tube, the key being formed with two halves which are pivotally connected in the vicinity of the handle, and wherein one of the halves is formed with a shoulder which keeps the legs parallel to each other when the legs are moved together.

3. A tube key according to claim 1 or claim 2, wherein the legs are at least twice as long as the average unsqueezed diameter of the tube for which the tube key is to be used.

* * * * *